United States Patent [19]

Fischman

[11] Patent Number: 4,811,856

[45] Date of Patent: Mar. 14, 1989

[54] TAMPER PROOF BOTTLE NECK INSERT, INDUCTIVELY WELDED TO A PLASTIC BOTTLE

[76] Inventor: Harry H. Fischman, 9436 Kostner Ave., Skokie, Ill. 60076

[21] Appl. No.: 198,072

[22] Filed: May 24, 1988

[51] Int. Cl.[4] ..... B65D 41/34

[52] U.S. Cl. ..... 215/250; 215/232

[58] Field of Search ..... 215/1 C, 250, 222, 365, 215/31, 8, 230

[56] References Cited

U.S. PATENT DOCUMENTS

| | | | |
|---|---|---|---|
| 579,867 | 3/1897 | Fenn | 215/31 |
| 809,258 | 1/1906 | Herrington | 215/365 |
| 870,312 | 11/1907 | Parker | 215/365 |
| 931,216 | 8/1909 | Phillips | 215/365 |
| 1,070,516 | 8/1913 | O'Brien | 215/1 C |
| 2,030,617 | 2/1936 | Whitney | 215/8 |
| 2,030,618 | 2/1936 | Whitney | 215/8 |
| 3,080,990 | 3/1961 | Parkinson et al. | 215/31 |
| 4,011,961 | 3/1977 | Widen et al. | 215/232 |
| 4,429,803 | 2/1984 | Butterfield | 215/366 |
| 4,553,679 | 11/1985 | Hatakeyama et al. | 215/232 |
| 4,576,297 | 3/1986 | Larson | 215/250 |
| 4,588,098 | 5/1986 | Uzdy | 215/250 |
| 4,684,554 | 8/1987 | Ou-Yang | 428/35 |
| 4,685,579 | 8/1987 | Stapleton | 215/230 |

FOREIGN PATENT DOCUMENTS

| | | | |
|---|---|---|---|
| 1192519 | 1/1958 | France | 215/1 C |
| 1322186 | 1/1962 | France | 215/1 C |
| 534594 | 7/1955 | Italy | 215/1 C |
| 2132978 | 1/1983 | United Kingdom . | |

*Primary Examiner*—George T. Hall

[57] ABSTRACT

The present invention provides an audible sound protecting mechanism and a tamper proof disc to prevent and deter persons from implanting contaminated substances into bottles containing capsules, tablets or caplets, removing the contents of the bottle, changing their composition, replacing the contents back into the bottle and restoring the bottle to its original condition so as to appear untouched, for the purpose of doing harm to another person. The safety disc that protects the products is so positioned inside the neck of the bottle, that is is beyond the reach and manipulations of anyone; therefore, if broken, the safety disc cannot be replaced, repaired, or repositioned.

7 Claims, 3 Drawing Sheets

FIG. 1
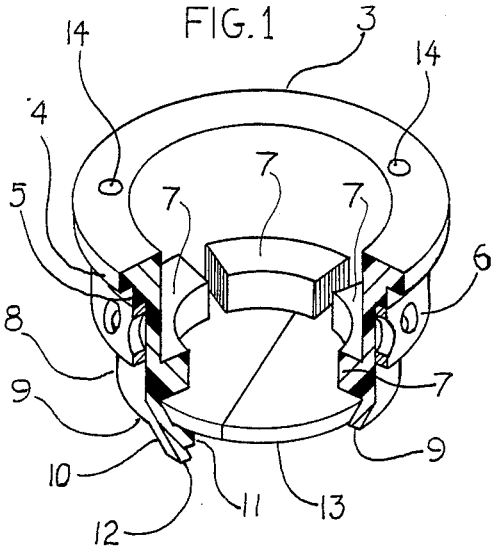
FIG. 2
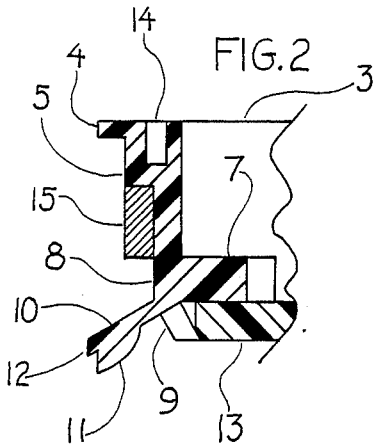
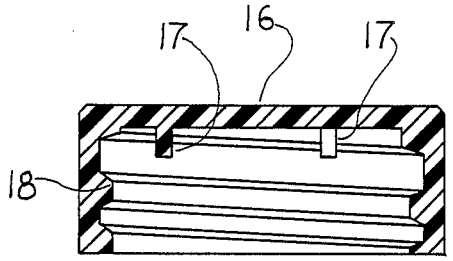
FIG. 3
FIG. 4
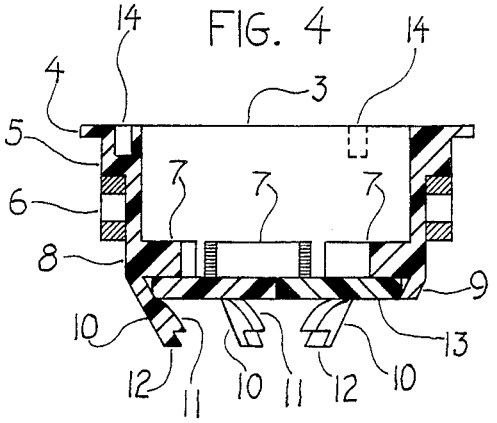
FIG. 5
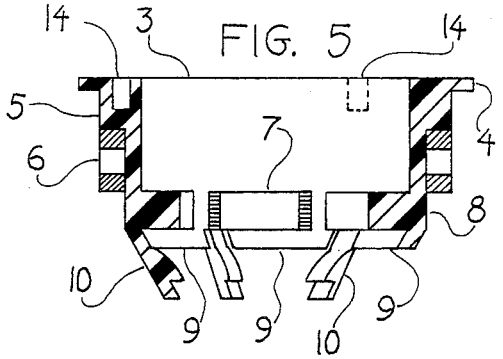
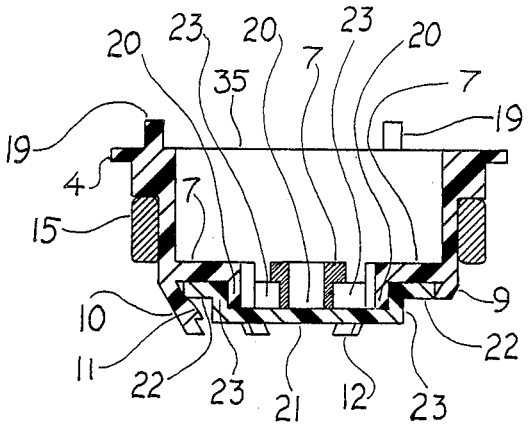
FIG. 6

TAMPER PROOF BOTTLE NECK INSERT, INDUCTIVELY WELDED TO A PLASTIC BOTTLE

BACKGROUND OF THE INVENTION

The present invention addresses the problem of providing complete protection to plastic bottles from tampering at the mouth of the bottle, and also provides a method of attaching the invention to the bottle cap and then bonding the invention to the plastic bottle by induction, thereby providing a new method of joining plastic to plastic inductively.

Prior art has produced numerous devices that address various aspects of the problem, yet all of them have various drawbacks. Generally, the devices currently in the market place provide very little if any protection. Any person with an ordinary laundry iron can easily remove the foil seal from a plastic bottle, contaminate the contents and then replace the same seal.

The present invention is an improvement over the prior art in that it provides a novel and unique method of frictionally by means of projections and cavities, or adhesively attaching a plastic safety insert inside a screw or snap on cap, where it remains until utilized in the bottling process. It also is an improvement over the prior art in that the invention has a sectioned internal shoulder, enabling the invention to be molded in one piece and still provide expandable projection supports that can be opened to receive and position a safety disc and then can be closed to hold the safety disc. The invention also provides a piece that enables the invention to be bonded to the plastic bottle by the induction method.

SUMMARY OF THE INVENTION

The present invention is a plastic neck insert, consisting of an insert body, a two piece, or a one piece safety disc, a perforated metal weld band or weld coil which is positioned either on the insert or in the bottle. The insert assembly is then positioned inside the screw or snap on cap preferably by projections and cavities on the insert and in the cap. After the tablets, caplets or capsules are placed in the bottle, the cap with the insert assembly is positioned in the bottle. The safety insert is then bonded to the bottle by induction. When the customer twists the cap to open it, the parts that hold the insert in the cap will be broken and an audible sound will be heard. The cap can then be removed leaving the insert bonded to the bottle.

To achieve this, the invention includes an insert molded in plastic, having a rim, an outside shoulder, a perforated metal weld band positioned under the shoulder, a plurality of cavities or projections on the insert top, and an internal shoulder divided into sections. The bottom of the insert has tapered sides and a number of equally spaced tapered projections extending downward in a configuration that provides a horizontal support platform which securely holds the plastic safety disc to the bottom of the sectioned internal shoulder.

For each tapered projection having a disc support configuration, there will be a break in the internal shoulder, this enables the steel mold that creates the disc support configuration to be released.

The insert is then placed in a screw or snap on cap where cavities or projections in the cap engage the projections or cavities on the insert, and frictionally hold the parts together until they are positioned in the bottle. If the insert is placed in a snap on cap, the attachment to the insert may be different as will be shown in the detailed explanation.

Various other features, objects and advantages of the present invention will become obvious to those skilled in the art upon reading the disclosures set forth hereinafter.

BRIEF DESCRIPTION OF THE DRAWING

Referring now to the drawings which illustrate some presently preferred embodiments of the invention wherein:

FIG. 1 is a perspective view partly in section of a safety disc bottle neck insert in accordance with the present invention.

FIG. 2 is a sectional view of the side wall portion of the safety disc bottle neck insert showing the flexible disc support projection in its expanded position.

FIG. 3 is a sectional view of a bottle screw cap showing cap projectons which will hold the safety disc bottle neck insert in the cap.

FIG. 4 is a sectional view of FIG. 1 showing the complete safety disc bottle neck assembly.

FIG. 5 is a sectional view similar to FIG. 4 showing the safety disc bottle neck insert prior to the positioning of the safety disc.

FIG. 6 is a sectional view of another embodiment of the safety disc bottle neck insert in accordance with the present invention.

DETAILED DESCRIPTION OF THE PREFERRED EMBODIMENTS

Figure 7:
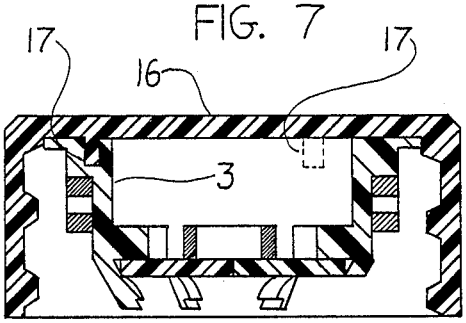
FIG. 7 is a sectional view of the safety disc bottle neck insert positioned within and attached to the screw cap prior to insertion into the bottle.

Referring to the drawings in which like parts are denoted by the same reference numerals throughout. FIG. 1 shows the preferred embodiment. Numeral 3 designates the tamper proof bottle neck insert, which is comprised of a molded cylindrical plastic piece, having a rim stop 4, an insert cavity 14, an outside shoulder 5, a perforated metal weld band 6, a sectioned internal shoulder 7, a vertical side wall 8, a tapered disc retainer 9, a tapered flexible safety disc support projection 10 having a disc support configuration 11 on its inner wall, a projection tip 12, with a two piece safety disc 13 positioned under the sectioned internal shoulder 7, and above the disc support 11.

FIG. 2, shows a portion of the bottle neck insert 3, with a weld coil 15. The projection tip 12, has been grasped and pulled outward showing the flexible support projection 10, in its open position.

FIG. 3, shows a screw cap 16, screw threads 18, and cap projections 17.

FIG. 4, shows the bottle neck insert 3, with the safety disc 13, being held firmly in place by three of the disc supports 11. Each break in the internal shoulder 7, is next to or above a flexible disc support projection 10.

FIG. 5, shows the bottle neck insert 3 minus the safety disc 13. This view shows the relationship of disc retainer 9, to the flexible disc support projection 10. Disc retainer 9, is contiguous to flexible disc support projection 10, but does not touch it. This allows flexible disc support projection 10, to move independently of disc retainer 9, which remains stationary.

FIG. 6, shows another embodiment of the bottle neck insert 3. Numeral 35 designates a tamper proof bottle neck insert comprising a rim projection 19, a rim stop 4, a weld coil 15, a flexible disc support projection 10, a disc support 11, a disc retainer 9, a sectioned internal shoulder 7, a disc shield 20, a one piece safety disc 21 having a rim 22, and a side wall 23.

The one piece pie-pan shaped safety disc 21, is positioned and held in place at the rim 22, between disc support 11, disc retainer 9, and internal shoulder 7.

To assemble the bottle neck insert 3, the perforated metal weld band 6, is first positioned as a tight fit under and against the outside shoulder 5. Pressure is exerted against the projection tip 12, which moves the flexible safety support projection 10, to the open position as shown in FIG. 2, the two piece safety disc 13, is then positioned and held in place by the tapered disc retainer 9. The flexible safety support projection 10, is then moved to the closed position so that the disc support 11 firmly engages the underside of safety disc 13.

The assembled bottle neck insert 3, is then positioned in the screw cap 16, shown in FIG. 3 by aligning the cap projections 17, of the screw cap 16, with the insert cavities 14, on the bottle neck insert 3, and then frictionally attaching the units together as shown in FIG. 7.

Figure 8:
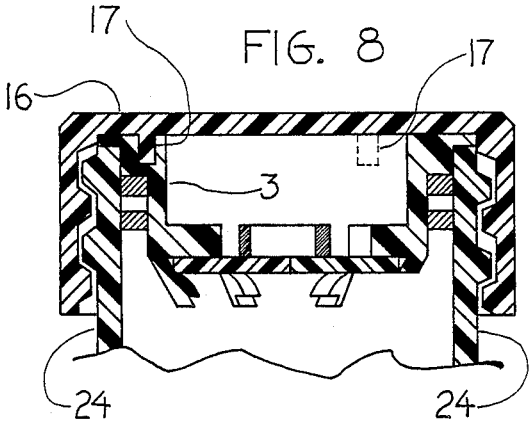
FIG. 8 is a sectional view similar to FIG. 7 showing the screw cap and the safety disc bottle neck insert positioned in the bottle prior to induction.

The screw cap 16, with the bottle neck insert 3, positioned within it is then positioned in the mouth of the bottle 24, as shown in FIG. 8. It should be noted that the cap projections 17, of the screw cap 16, and the insert cavities 14, of the bottle neck insert 3, may be reversed. The cap projections 17, can be positioned on the insert as rim projections 19, as shown in FIG. 6, while the female cavities 14, can be molded into the screw cap 16, to frictionally attach the bottle neck insert 3, to the screw cap 16.

The perforated weld band 6, which is in contact with the insert side wall 8, and the bottle wall 24, is now inductively heated and bonds the bottle neck insert 3, to the bottle 24.

As the plastic bottle 24 proceeds along the bottling line after bonding, the screw cap 16, can be twisted counter clockwise to break the cap projections 17, then clockwise to retighten the screw cap 16, to allow the screw cap 16, to be easily removed. The preferred procedure would be to allow the customer to twist and break the cap projectons 17, at the interface between the screw cap 16, and the insert 3. The cap projections 17, will be of such small diameter as to easily allow anyone to break the connecting projections. A distinct crack will be heard upon twisting the screw cap 16 open.

Figure 9:
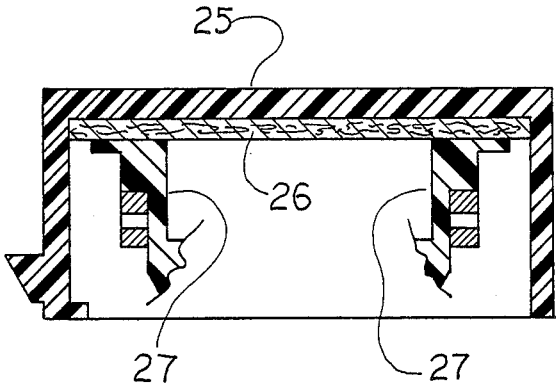
FIG. 9 is a sectional view of another embodiment in accordance with the present invention, showing the sidewall portion of the safety disc bottle neck insert assembled in a snap on cap.
Figure 11:
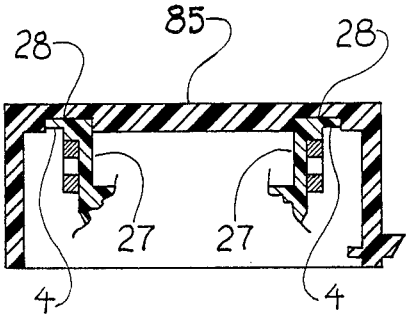
FIG. 11 is a sectional view of the snap on cap as shown in FIG. 10 with the safety disc bottle neck insert attached thereto.

FIG. 9, and FIG. 11, show other embodiments in accordance with the present invention. FIG. 9, shows the bottle neck insert 27, adhesively attached to the pulp-board backing 26, by an adhesive which easily peels away from the bottle neck insert 27. The pulp-board backing 26, is adhesively attached to snap on cap 25 in the conventional manner. Snap on cap 25, and the bottle neck insert 27, have no cap projections 17, or insert cavities 14.

Snap on cap 25, with the bottle neck insert 27 attached, is positioned in a plastic bottle 24, the bottle neck insert 27, is then inductively bonded to the plastic bottle 24. When the customer pulls the snap on cap 25, off the plastic bottle 24, the adhesive attaching the insert 27, to the pulp-board backing 26, having a greater affinity for the pulp-board backing 26, will therefore peel away from the plastic insert 27, and remain adhered to the pulp-board backing 26, inside snap on cap 25.

Figure 10:
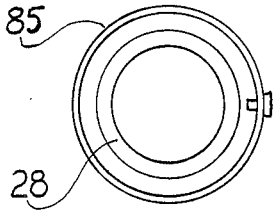
FIG. 10 shows still another embodiment in accordance with the present invention of a snap on cap as seen from below.

FIG. 10, shows a snap on cap 85, as viewed from below, having an insert recess 28, molded into it. Bottle neck insert 27, is frictionally attached to snap on cap 85, at the insert recess 28 as shown in FIG. 11, and is then positioned in a plastic bottle 24, then the bottle neck insert 27, is inductively bonded to the bottle 24.

Figure 12:
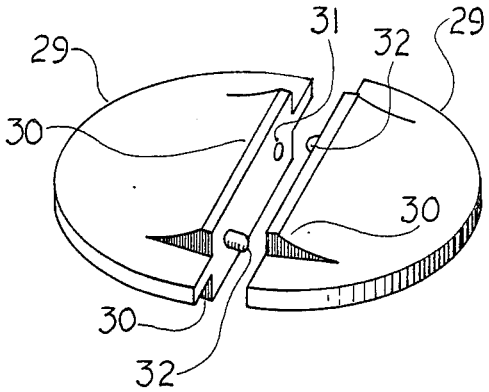
FIG. 12 is a perspective view of a two piece molded safety disc in accordance with the present invention.

FIG. 12 shows a two piece molded safety disc 29, comprising a disc rise 30, a disc cavity 31, and a disc projection 32. Safety disc 29, is the preferred embodiment to safety disc 13, because when assembled, the disc projection 32, mated with the disc cavity 31, and the disc rise 30, give the safety disc 29, more stability without interfering with its breakaway feature. Once the two piece disc 29, breaks away into the bottle, the disc projections 32, would make it impossible to re-assemble the disc 29.

Figure 13:
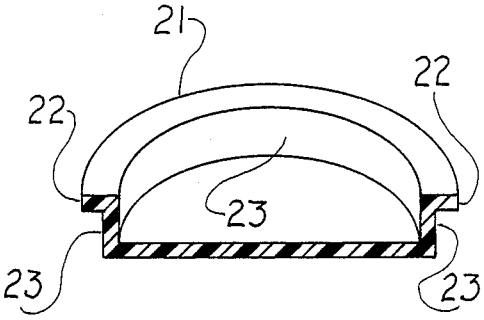
FIG. 13 is a sectional view of a one piece safety disc similar to the safety disc shown in FIG. 6.

One piece disc 21, shown in cross section in FIG. 13, shows the pie-pan shaped configuration, the disc rim 22, and the disc side wall 23. If a one piece disc is used in the insert 3, there could be the possibility of a tampering attempt. Disc 21, positioned in insert 35 of FIG. 6, overcomes that. When the safety disc 21 has been pushed into the bottle the flexible safety disc support projection 10, in its normal closed position, prevents the safety disc 21 from being pulled back and repositioned; disc shield 20, positioned under the front portion of the sectioned internal shoulder 7, in front of disc side wall 23, protects safety disc support projection 10, from any tampering. Any attempt at cutting away safety disc support projection 10, would so damage the disc shield 20, and the sectioned internal shoulder 7, that it would be immediately evident to anyone that a tampering attempt had been made.

Figure 14:
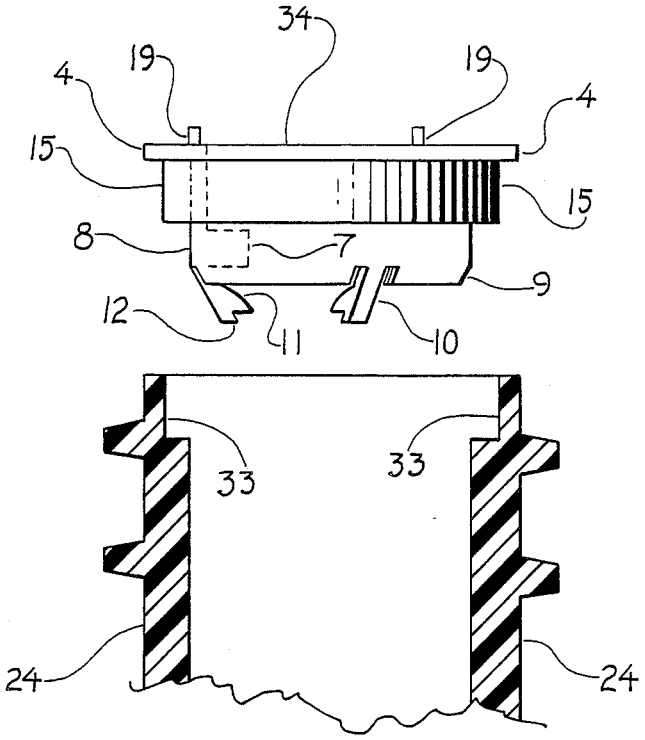
FIG. 14 is a side view of the safety disc bottle neck insert and a cross section of the bottle neck showing still another embodiment in accordance with the present invention.

FIG. 14, shows still another embodiment in accordance with the present invention. The bottle neck insert 34, has no outside shoulder 5. Weld coil 15, or perforated metal weld band 6, is positioned on the outside of the insert 34, up against the insert rim stop 4. Bottle 24, has a recess 33 cut into the bottle mouth in which the weld coil 15, or the perforated metal weld band 6, will rest when the insert 34 is positioned in bottle 24.

The disclosure of the invention described above represents the preferred embodiments of the invention: however, variations, thereof, in the form, construction, and arrangement of the various components thereof and the modified application of the invention are possible without departing from the spirit and scope of the appended claims.

I claim:

1. A tamper proof bottle neck insert comprising a cylindrical insert of plastic, a first means adapted to form configurations and projections on the outside periphery of said tamper proof bottle neck insert, to receive and position a perforated or solid coil weld band; A second means adapted to form tapered, flexible disc support projections to securely position and retain a tamper proof disc; A third means adapted to form an internal shoulder on the inside periphery of said tamper proof bottle neck insert with intermittent open sections to enable the mold form that creates the said tapered flexible disc support projections to be withdrawn; A fourth means adapted to form configurations, projections and cavities on the outside periphery of the said tamper proof bottle neck insert, and the inside periphery of a screw or snap on cap to allow the said tamper proof bottle neck insert to be positioned and frictionally retained in said screw or snap on cap; A fifth means adapted to position said cap and said insert into said bottle, and to permanently bond said insert to said bottle by induction.

2. A tamper proof bottle neck insert comprising a cylindrical insert of plastic, said insert having a rim with projections or cavities a shoulder formed on the outside periphery of said insert, a perforated metal weld band or weld coil positioned under said shoulder, a segmented internal shoulder formed on the inside periphery of said insert, a tapered extension at the bottom of said insert, a plurality of tapered, flexible projections extending from the bottom of said insert, said tapered flexible projections having a disc support projection on its inner periphery, and an extended tip; By pushing outward on said extended tip, said tapered flexible projections can be moved out of the way allowing a safety disc to be positioned within said tapered extension, said tapered flexible, projections would then be pushed back to the normally closed position allowing the said disc support projections to make contact with and provide a support platform for said safety disc.

3. A bottle cap formed of plastic, said bottle cap comprising configurations, projections or cavities on its inside periphery, to position, mate with, and to frictionally retain said bottle neck insert; Said bottle cap with said insert retained within it is then positioned in a plastic bottle, said insert is then bonded to said plastic bottle by induction.

4. A tamper proof bottle neck insert comprising a cylindrical insert of plastic, said insert having configurations , projections or cavities, to be positioned, and frictionally retained within a plastic cap; said insert having a rim, a perpendicular wall with no outside shoulder, a perforated weld band, or weld coil positioned on the outside periphery of said insert under said rim, said insert is then positioned and retained in a plastic cap, said plastic cap having projections and cavities to retain said plastic insert, said insert and said cap are then positioned in a plastic bottle, said bottle having recesses in its inner periphery to receive and position said perforated weld band or weld coil, said insert is then bonded to said bottle by induction.

5. A tamper proof bottle neck insert as described in claim 2, said tamper proof bottle neck insert further having a disc shield positioned at the front end of said segmented internal shoulder and extending downward to protect a one piece safety disc.

6. A plastic safety disc as described in claim 2, comprising two equal parts, each part having a disc rise, a projection, and a cavity; The said projection will mate with the said cavity of each part and will form said safety disc.

7. A plastic safety disc as described in claim 5, comprised of one piece having a pie-pan shaped configuration, said one piece safety disc having a sidewall and a rim portion or flange.

* * * * *

UNITED STATES PATENT AND TRADEMARK OFFICE

CERTIFICATE OF CORRECTION

PATENT NO. : 4,811,856

DATED : March 14, 1989

INVENTOR(S) : Harry Fischman

It is certified that error appears in the above-identified patent and that said Letters Patent is hereby corrected as shown below:

In the ABSTRACT OF THE DISCLOSURE on line 10, eliminate the last word on the line - is - and insert in its place the word - it In Claim 2 of my claims, on line 3, a comma (,) should be inserted after the word - cavities - and before the word - a

Signed and Sealed this

First Day of August, 1989

*Attest:*

*Attesting Officer*

DONALD J. QUIGG

*Commissioner of Patents and Trademarks*